United States Patent [19]

Thompson

[11] Patent Number: 4,664,143

[45] Date of Patent: May 12, 1987

[54] EXTERNAL WATER TOWER

[76] Inventor: Ernest N. Thompson, Box 136, Ridgeway, Iowa 52165

[21] Appl. No.: 870,198

[22] Filed: Jun. 3, 1986

[51] Int. Cl.[4] ..... F04B 49/00

[52] U.S. Cl. ..... 137/567; 137/592; 137/624.15; 137/624.20; 417/12; 417/28

[58] Field of Search ..... 137/567, 566, 624.13, 137/624.15, 624.18, 624.20, 59, 61; 417/12, 43, 28

[56] References Cited

U.S. PATENT DOCUMENTS

| | | | |
|---|---|---|---|
| 2,128,617 | 8/1938 | Lawlor | 137/592 |
| 3,812,872 | 5/1974 | Block et al. | 137/61 |
| 3,957,395 | 5/1976 | Ensign | 417/28 |
| 4,034,421 | 7/1977 | Pihl et al. | 137/556 |
| 4,249,565 | 2/1981 | Brust | 137/495 |
| 4,481,966 | 11/1984 | Anderson | 137/59 |

*Primary Examiner*—A. Michael Chambers
*Attorney, Agent, or Firm*—Allan L. Harms

[57] ABSTRACT

A water supply recirculation system is provided having a recirculation pump and a duct into which the recirculation pump propels water. A selectively operated, closed at rest, flow valve is maintained open while the pump operates. A flow sensor serially installed in the recirculation duct detects flow and senses a failed condition. A second control valve which rests in an open position selectively prevents passage of water from the recirculation duct into a drain duct when pumping is in progress. The recirculation duct transmits water into a water supply tank and discharges it onto the central surface of the water supply in the tank. When pumping ceases, the first control valve closes, and the second control valve opens, allowing water in the duct to drain from the duct.

13 Claims, 3 Drawing Figures

EXTERNAL WATER TOWER

BACKGROUND OF THE INVENTION

This invention relates to water supply freeze avoidance devices for municipal or other water supply tanks. In northern climates of the United States, there are many small towns which have municipal water supplies contained within tanks mounted upon elevated towers. Because of the nature of small town life, the volume of water drawn from the water tower during late night and early morning hours is quite small. Because of this, many small municipalites are confronted with the annual problem of the water supply within the water tower tank freezing over, resulting in the necessity to defrost the water tower with steam or other heating means at considerable expense and inconvenience. Because little if any discharge of water from the water supply tank occurs during nighttime hours, the water in tanks is allowed to become still and freezing occurs on top of the water supply and along the tank walls. Ice layers as much as six feet thick have been experienced. When the water tower supply fully freezes over, it is difficult to draw water from the tank, even though elevated, due to the differential air pressures between the outlet pipe and the top of the water supply under the ice cap.

When steam heating means are employed to de-ice the water tower, handlers of the steam equipment must climb the tower and supply heated steam to the tank walls and ice cap covering the water supply. Such work is dangerous, unpleasant, and expensive for the municipality.

An alternative method employed by smaller towns in dealing with the freezing problem is to allow a continual water discharge from the water tower into city sewers or through the overflow drain onto the ground. In some instances, the overflow drain spills water directly out of the tank resulting in an ice build-up at the base and legs of the water tower. With either of these methods, water is wasted, along with the power needs of the main system pump in continually filling the water tank.

Water supplies in large municipalities do not suffer from problems of this degree because of their larger populations and the likelihood that the water supply will be utilized both night and day. Furthermore, water towers of recent vintage are employed with an agitation system to provide a source of continually moving water into the tank which operates whether it is winter or summer.

SUMMARY OF THE INVENTION

This invention relates to an external water tower circulator. A timed secondary water supply is circulated through a municipal water supply tank on a timed basis. Water is drawn from the main water service pipe and is pumped by a small pump into the top of the water tower and is discharged into the central portion of the water supply onto its surface. A control system is employed to open and close the circulation water supply lines and to time the operation of the pump for certain periods during low water usage and to discontinue pumping at the times normal municipal water usage will be expected. A failure detection element is provided to shut down the recirculation system if power failure or other system element failure occurs. Control means are provided to drain the recirculation pipe when the recirculation system is not powered.

An object of the invention is to provide an ice prevention system for a municipal water supply.

Another object of the invention is to provide a recirculation system which can be easily incorporated in a municipal water supply system.

Another object of the invention is to provide a timed water recirculation system.

These and other objects will be apparent from the description below.

DESCRIPTION OF THE DRAWINGS

FIG. 3 shows the electrical circuitry of the control panel 40 of FIG. 2.

DETAILED DESCRIPTION OF THE INVENTION

Figure 1:
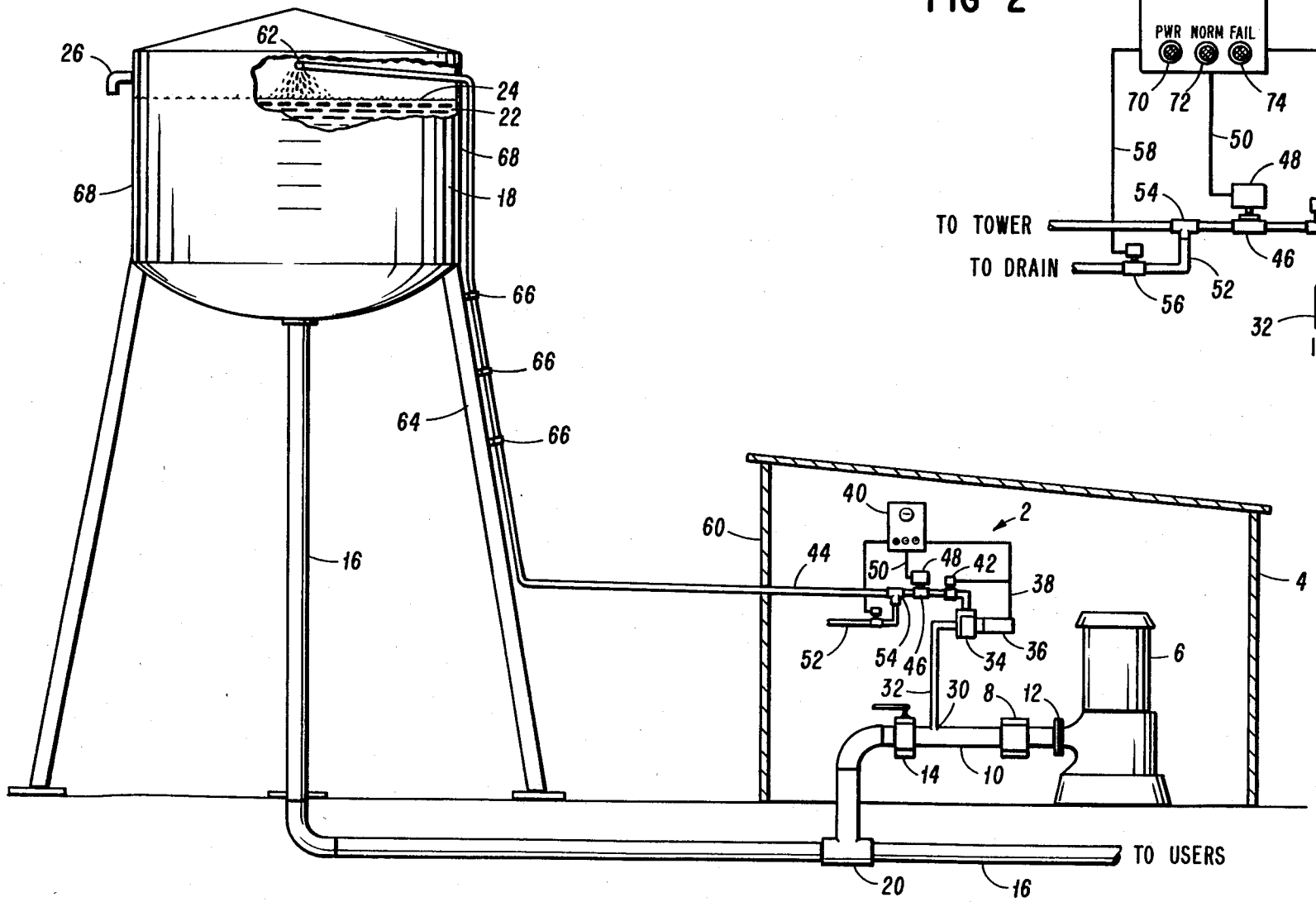
FIG. 1 schematically shows the system invention connected to a municipal water supply system.

FIG. 1 shows the system invention 2 installed in the typical pump house 4 associated with a municipality's main water supply pump 6. The main municipality's water supply, which is well-known, consists of the main water supply pump 6 which propels water into main supply pipe 10 which is coupled to pump 6 at coupling 12. Water propelled into main supply pipe 10 passes check valve 8 which prevents re-entry of water into pump 6 from main supply pipe 10. Also incorporated in main supply pipe 10 is control valve 14 which is closed when repairs to pump 6 are needed. Main supply pipe 10 communicates with main service line 16 at T-coupling 20. Main service line 16 supplies water from tower tank 18 to the municipality's users. If pump 6 is allowed to overfill tower tank 18, water surface 24 will rise until water spills out overflow pipe 26. In some installations, overflow pipe 26 is extended to connect to the city's sewer system to receive overflow.

The system invention 2 interconnects with main supply pipe 10 at joint 30 such that recirculation supply line 32 communicates with main supply pipe 10. Water from main supply pipe 10 is drawn into recirculation supply line 32.

Figure 2:
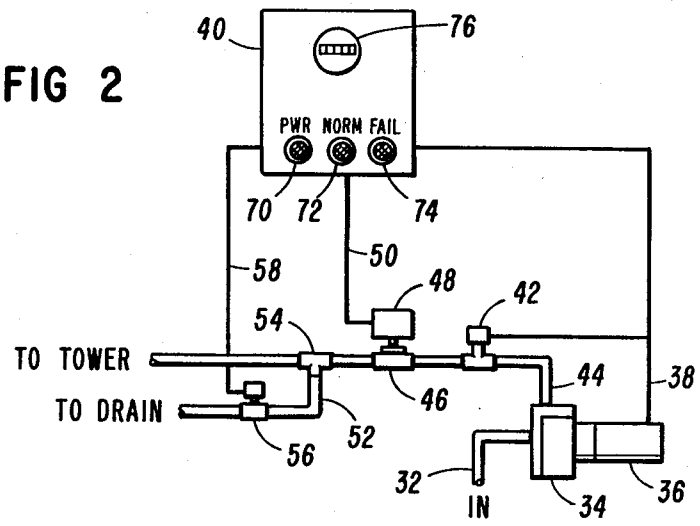
FIG. 2 shows the system invention schematically.

Referring now to FIG. 2 as well as FIG. 1, it can be seen that recirculation pump 34 is selectively powered by motor 36 when it is energized. Control lines 38 communicate control signals from control panel 40 to motor 36. Typically control is through electrical means but could be through hydraulics as well. First control valve 42 is in closed position when at rest, that is to say, it is a normally closed switch and may be controlled by an electrical solenoid. When electricity or other energization means is passed along motor control lines 38 to motor 36, first control valve 42 is retained open, thereby permitting water to be propelled by recirculation pump 34 within duct 44. When power is removed from control lines 38, first control valve 42 closes and motor 36 rests. Water in recirculation duct 44 is thereby prevented from returning to recirculation pump 34. Flow sensor 46 is serially placed along duct 44 to detect passage of water therealong. Flow controller 48 translates flow detection by flow sensor 46 into control signals which are transmitted along second control lines 50 to control panel 40.

Duct 44 communicates with drain duct 52 at T-coupling 54. Second control valve 56 rests in an open position, that is, it is a normally open switch. Third control lines 58 interconnect second control valve 56 with control panel 40 to transmit control signals therebetween. Drain duct 52 empties into a suitable drain when recirculation of water by recirculation pump 34 is completed. Therefore when water is not propelled by recirculation pump 34, first control valve 42 closes and water in duct 44 is allowed to pass along drain duct 52 due to de-energized second control valve 56 which is open at rest.

After exiting pump house wall 60 duct 44 leads to outlet 62 which is positioned within tower tank 18 above the level of overflow pipe 26. The routing of duct 44 from pump house 4 to tower tank 18 is not critical. In this preferred embodiment of the invention, recirculation duct is fastened to tower leg 64 by fasteners 66. Duct 44 enters sidewall 68 of tower tank 18 above water surface 24 and above the level of overflow pipe 26 where overflow pipe 26 passes through sidewall 68. The entry of duct 44 into tower tank 18 is not critical except as to the water seal about the entry point. In retrofit operations, it is found that entry above the overflow pipe is simple, effective and trouble free. Outlet 62 directs water flowing from duct 44 toward the center of the water surface 24 of water supply 22. It is preferred to surround duct 44 with thermal insulation whenever it is outside pump house 4.

Control panel 40 is equipped with monitoring indicators 70, 72 and 74. First indicator 70 informs the observer when the system invention is energized. Second indicator 72 informs the observer when operation is normal. Third indicator 74 informs the observer when a failure in this system has occurred. Meter 76 of control panel 40 discloses the time elapsed while the system invention 2 was operating.

FIG. 3 discloses the electrical circuitry of control panel 40 of invention 2. A timer 80 selectively provides nominal 110 VAC to first relay 82 and to indicator 70 which indicates electrical power is supplied to invention 2. In the preferred embodiment, timer 80 is a 24 hour timer which provides power during late night and early morning hours. Time delay switch 84 closes a preset time interval after application of 110 VAC to first relay 82 thereby effecting the energizing of first relay 82 and the reaction of first relay contact 86 from resting contact 88 to switched contact 90. Timer 80 is also coupled to first relay contact 86.

When at rest, first relay contact 86 is coupled through connection 89 to magnetic starter 92, to first control valve 42, to second control valve 56, to indicator 72, to meter 76 and to controller 48. Second relay 94 is coupled to the "No Flow" output of controller 48 and to third indicator 74. The opposing connections to third indicator 74 and second relay 94 are common returns through ground. Second relay contact 96 at rest couples electrical ground through connection 87 to magnetic starter 92, second indicator 72, meter 76, first control valve 42 and second control valve 56 through resting contact 98. When second relay 94 is energized, second relay contact 96 disconnects said ground coupling from second resting contact 98. When second relay 94 is energized, magnetic starter 92 de-energizes, thereby de-coupling motor 36 from the 220 VAC power supply due to opening of double throw switch 100. Controller 48 is coupled to switched contact 90 which interacts with first relay 82. Controller 48 passes electrical current to first terminus 102 when flow detection is positive and to second terminus 104 when no flow is detected. Only when second terminus 104 is energized does second relay 94 become energized to cause second relay contact 96 to switch from second resting contact 98 to open contact 97.

OPERATION OF THE INVENTION

The system operator chooses the length of recirculation pumping to be performed through the nighttime hours by setting the timer within control panel 40. For example, if the recirculation system is to be operated between 10:00 p.m. and 6:00 a.m., the timer is so set. At the starting time, the motor 36 will be energized through control lines 38 to start recirculation pump 34. Also, first control valve 42 is energized, thereby opening to allow flow in duct 44 from pump 34. Also, second control valve 56 is energized, closing the valve and preventing flow along drain pipe 52. Recirculation pump 34 and motor 36 are selected to provide water flow appropriate for the amount of water 22 stored in tower tank 18. It is found that 25 gallons per minute is sufficient for 50,000 gallon capacity tanks, 50 gallons per minute for 75,000 gallon tanks and 100 gallons per minute for 500,000 gallon tanks. The inner diameter of duct 44 is minimally 1.25 inches and must be increased if flow above 25 gallons per minute is contemplated.

The application of electrical power to the system invention 2 is indicated by the energizing of first indicator 70. The running of pump 34 is indicated by indicator 72. Length of running time is indicated by meter 76. Flow of water is sensed by flow sensor 46 and if sensed while power to motor 36 is provided, controller 48 signals control panel 40 to continue operation of motor 36. If flow is not sensed in duct 44 by flow sensor 46, a signal is given by controller 48 to de-energize motor 36, first control valve 42 and second control valve 56. When motor 36 stops, recirculation pump 34 stops propelling water, first control valve 42 closes to prevent passage of water toward pump 34 and second control valve 56 opens allowing water in duct 44 to discharge through drain pipe 52 to the appropriate drain.

Having described the invention,

I claim:

1. Apparatus to circulate water in a municipal water system having a water supply tank, a main water service line and a main water pump, the invention comprising:
   - a second pump having an input and an output, said second pump driven by a motor,
   - a first duct interconnecting the output of said second pump with said water supply tank,
   - a first control valve selectively controlling flow along said first duct,
   - a flow detector detecting flow along said first duct,
   - a second duct interconnecting said input of said second pump to a supply of water,
   - a discharge duct communicating with said first duct,
   - a second control valve selectively controlling flow along said discharge duct,
   - a controller selectively engaging said first and second valves and said motor,
   - said first control valve being closed when said second control valve is open,
   - said first control valve being opened when said second control valve is closed,
   - said flow detector interacting with said controller to effect disengagement of said motor when flow is not detected in said first duct.

2. The invention of claim 1 wherein said first duct terminates within said water supply tank above the level of water contained therein, said first duct having a terminating element upon its termination within said water supply tank, said terminating element directing water flowing from said first duct contrally onto the surface of said water supply within said water supply tank, said terminating element of said first duct being disposed within said water supply tank above the level of an overflow discharge opening in said tank.

3. The invention of claim 1 wherein said second duct communicates with a main service line to the main water supply pump, said first control valve positioned between said second pump and said communication of said discharge duct with said first duct, said flow detector positioned along said second duct between said first control valve and said communication of said discharge duct with said first duct.

4. The invention of claim 1 wherein said controller includes timer means to provide selective engagement of said first control valve and said second control valve and said motor at predetermined time intervals.

5. The invention of claim 1 wherein said first duct terminates within said water supply tank above the level of water contained therein, said duct having a terminating element upon its termination within said water supply tank, said terminating element directing water flowing from said first duct centrally onto the surface of said water supply within said water supply tank, said terminating element of said first duct being disposed within said water supply tank above the level of an overflow discharge opening in said tank, said second duct communicates with a main service line to the main water supply pump, said first control valve positioned between said pump and said communication of said discharge duct with said first duct, said flow detector positioned along said duct between said first control valve and said communication of said discharge duct with said first duct, said controller includes timer means to provide selective engagement of said first control valve and said second control valve and said motor at predetermined time intervals.

6. The invention of claim 5 wherein said first control valve is opened when said motor is energized, said second control valve is closed when said motor is energized, said flow detector is energized a fixed time interval after said motor is energized, when said flow detector is energized and detects flow along said first duct, said flow detector signals said controller to continue energizing said motor and said first control valve and said second control valve.

7. The invention of claim 6 wherein said controller engages said motor, said first control valve and said second control valve by electrical means, said flow detector signals said controller by electrical signals.

8. The invention of claim 7 wherein said controller comprises, a twenty-four hour timer, first, second and third indicators, a time delay relay, a first relay interconnecting said first control valve and said second control valve to electrical ground when said first relay is not energized, a second relay which interconnects said motor to electrical power when said second relay is energized, a meter energized when said motor is energized, said first relay interconnects said second relay to electrical ground when said first relay is not energized, said twenty-four hour timer is selectively preset to apply electrical power to said time delay relay at predetermined periods, said time delay relay operates to provide electrical power alternately to said second relay and to said flow detector, said time delay relay provides electrical power to said second relay during its time delay, said time delay relay provides electrical power to said flow detector after elapse of the time delay of said time delay relay, said flow detector provides electrical power to said second relay when water flow is detected in said first duct, said flow detector provides electrical power to said first relay when flow is not detected in said first duct, said first indicator is coupled to said electrical power from said timer, said second indicator is coupled to said electrical power applied to said first relay, said third indicator is coupled to said electrical power when said second relay is energized.

9. The invention of claim 8 wherein said first indicator indicates a powered condition at said controller, said second indicator indicates a failed condition at said controller, said third indicator indicates an operating condition at said controller, said meter indicates elapsed time of power to said motor.

10. In a municipal water system having an above ground storage tank with water therein, a main water supply pump, and water main pipes interconnecting the main water supply pump and the above ground storage tank, the improvement comprising an exterior pipe intercommunicating the water supply tank and a recirculation apparatus, said exterior pipe communicating with said water supply tank above the water level thereof, said recirculation apparatus comprising an auxiliary pump having an intake and outflow, said auxiliary pump being driven by a selectively energized motor, a first duct interconnecting said intake of said auxiliary pump and said water main pipe, a second duct interconnecting said pump outflow and a first normally closed valve, a third duct interconnection said first normally closed valve to a drain pipe having a first normally open valve therewithin, a flow detector disposed within said third duct to detect presence of water flow in said third duct, said exterior pipe communicating with the interconnection of said third duct and said drain pipe, a timed controller selectively energizing said normally closed valve and said normally open valve, said controller energizes said normally open valve and said normally closed valve at the same time, said controller receives signals from said flow detector, said controller de-energizes said motor, said normally open valve and said normally closed valve when said flow detector senses no water flow, said controller de-energizes said motor and said normally open valve and said normally closed valve at predetermined times, said flow detector is delayed in operation a predetermined time interval upon energizing of said motor.

11. The invention of claim 10 wherein said controller engages said motor, said first control valve and said second control valve by electrical means, said flow detector signals said controller by electrical signals.

12. The invention of claim 11 wherein said controller comprises, a twenty-four hour timer, first, second and third indicators, a time delay relay, a first relay interconnecting said first control valve and said second control valve to electrical ground when said first relay is not energized, a second relay which interconnects said motor to electrical power when said second relay is energized, a meter energized when said motor is energized, said first relay interconnects said second relay to electrical ground when said first relay is not energized, said twenty-four hour timer is selectively preset to apply electrical power to said time delay relay at predetermined periods, said time delay relay operates to provide electrical power alternately to said second relay and to said flow detector, said time delay relay provides electrical power to said second relay during its time delay, said time delay relay provides electrical power to said flow detector after elapse of the time delay of said time delay relay, said flow detector provides electrical power to said second relay when water flow is detected in said first duct, said flow detector provides electrical power to said first relay when flow is not detected in said first duct, said first indicator is coupled to said electrical power from said timer, said second indicator is coupled to said electrical power applied to said first relay, said third indicator is coupled to said electrical power when said second relay is energized.

13. The invention of claim 12 wherein said first indicator indicates a powered condition at said controller, said second indicator indicates a failed condition at said controller, said third indicator indicates an operating condition at said controller, said meter indicates elapsed time of power to said motor.

* * * * *